US007874536B2

(12) United States Patent
Groover

(10) Patent No.: US 7,874,536 B2
(45) Date of Patent: Jan. 25, 2011

(54) ANGLE CEILING HANGER OR BRACKET

(76) Inventor: David O. Groover, 9207 N. CR 200 W., Lizton, IN (US) 46149

( * ) Notice: Subject to any disclaimer, the term of this patent is extended or adjusted under 35 U.S.C. 154(b) by 124 days.

(21) Appl. No.: 12/284,770

(22) Filed: Sep. 26, 2008

(65) Prior Publication Data

US 2010/0078542 A1 Apr. 1, 2010

(51) Int. Cl.
*A47H 1/10* (2006.01)
*A47H 1/00* (2006.01)

(52) U.S. Cl. ..... 248/343; 211/105.1; 211/105.2

(58) Field of Classification Search ..... 248/343; 211/105.1, 105.2, 123, 124
See application file for complete search history.

(56) References Cited

U.S. PATENT DOCUMENTS 918,415 A * 4/1909 Berger ..... 248/247
3,994,462 A * 11/1976 Shine ..... 248/248
6,053,465 A * 4/2000 Kluge ..... 248/235

* cited by examiner

*Primary Examiner*—Terrell Mckinnon
*Assistant Examiner*—Erin Smith
(74) *Attorney, Agent, or Firm*—Daniel O'Connor

(57) ABSTRACT

An angle ceiling bracket, hanger or support which is specially designed for use with sloped ceilings of the type found in attics or the second or third stories of residences or related building structures. The design is such that it has virtually universal application for any type or angle of sloped ceiling so that a new bracket need not be designed for various ceiling work sites. The hanger design is contemplated for use with closet clothes hanger rods and has many other possible uses.

1 Claim, 5 Drawing Sheets

ANGLE CEILING HANGER OR BRACKET

BACKGROUND AND OBJECTS OF THE INVENTION

The present invention is generally related to the construction and building arts and, in particular, to brackets, hangers or supports which have utility with sloped ceilings of the type found in attics or second or third stories of residential homes.

The storage of clothes on hangers in such sloped ceiling areas becomes a particular problem as it is desirable to keep the clothes from rubbing against wall areas. The sloped ceiling areas are of various angles so that it is often required that a construction engineer or construction personnel design a special bracket or hanger for the particular building.

Such creates costly and time consuming construction delays.

Accordingly, it is an object of the present invention to demonstrate an angle ceiling bracket or hanger which has utility with various sloped ceilings to speed the construction or remodeling process.

It is a further object of the invention to show a ceiling bracket having a more solid attachment and more load bearing capabilities as compared to mounting elements known in the art.

It is also an object to describe a ceiling bracket which may be economically manufactured for widespread commercial appeal and usage in the construction arts.

It is a further object to demonstrate a ceiling bracket which has multiple uses such as the suspension of gas lines, electric conduits and other plastic or metal conveyance lines which are suspended from sloped or flat ceiling areas in the construction arts.

These and other objects and advantages of the present invention will be apparent to those of skill in the building construction, remodeling and article suspension arts.

PRIOR ART PATENTS AND DESIGNS

During the course of preparing this specification for submission to the U.S. Patent and Trademark Office, a full search of the prior art was conducted in the hanger, bracket and support Classes 211 and 248.

U.S. Pat. No. 4,846,356, issued to Dubuc in 1989, teaches the use of a clothes drying rack which can be fixed to the ceiling of a bathtub area. Lower support racks are also shown.

U.S. Pat. No. 5,833,081, issued to Smith in 1998, shows the use of a clothes rack which is adapted to be placed within an automobile via extendable units.

U.S. Pat. No. 6,969,036, issued to Magnusson in 2005, teaches the use of different types of hooks and related devices to hang utensils from a mounting bracket.

The present invention, describing a specific hanger or bracket which is utilized in combination with a sloped ceiling of an attic, is believed to be clearly patentable over the prior art.

SUMMARY OF THE INVENTION

The invention comprises a bracket, hanger or support for a closet rod used to support clothing in an attic having a sloped roof.

The bracket is generally triangular in overall shape and includes left and right extended arms which, via a screw hole or aperture, retain the closet rod in a desired position.

The bracket further includes left hand and right hand mounting flanges which are secured to the attic sloped ceiling. Screw holes or apertures are provided in the mounting flanges.

Pilot holes or apertures are located in the end areas of the extended arms and enable a quicker and more secure attachment of the bracket to a sloped ceiling area.

The overall design may have widespread utility for suspending gas, electric or plastic lines of the type used in the construction arts.

BRIEF DESCRIPTION OF THE DRAWING FIGURES

FULL DESCRIPTION OF A PREFERRED EMBODIMENT

Figure 1:
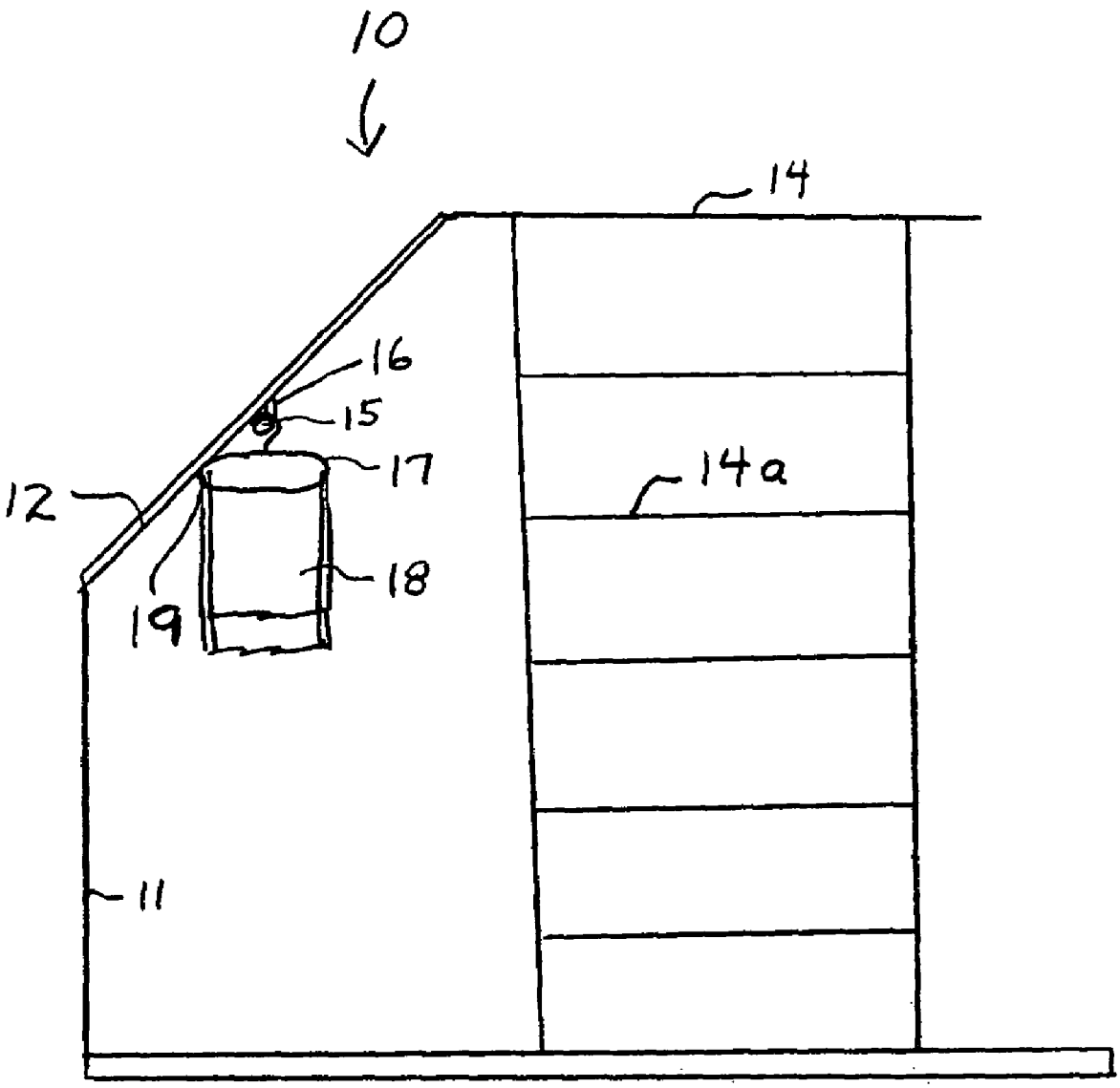
FIG. 1 is a partial schematic view of an attic having a sloped ceiling wherein it is desired to hang a closet rod.

Referring to the drawing figures, FIG. 1 shows, in schematic form, the attic or top story of a house or building structure indicated at numeral 10.

The attic 10 has a vertical wall 11 and a sloped ceiling shown at numeral 12.

A top horizontal ceiling portion 14 is shown over a full height wall which may be utilized for shelving 14*a*.

Clothing storage in such a sloped ceiling attic is typically done by means of a closet rod 15 which is supported by a support or bracket 16. Clothes hanger 17 holds clothing 18.

Importantly, the brackets or supports 16 currently available result in the clothing 18 rubbing against the sloped ceiling 12 as shown at numeral 19.

The present invention describes a specially designed bracket which eliminates the problem of clothing damage in sloped ceiling systems.

Storage space is at a premium in every household and it is thus critical to maximize such storage space without damaging the stored clothing items.

It is also critical that the ceiling brackets be very securely fastened to the sloped ceiling so that no damaging dropage occurs.

Another important aspect of the invention is that it enables sloped ceiling supports or brackets to be quickly and efficiently installed by construction and engineering personnel to thereby reduce construction time and costs.

As will be further shown and described, the support, bracket or hanger of the present invention accomplishes, inter alia, the following critical objectives:

- spacing of hung clothing away from the sloped ceiling wall so that clothing damage is avoided,
- an attaching method using inwardly extending flanges and pilot holes which results in a very secure bracket fastening to a sloped ceiling,
- a more rapid installation of supports or brackets.

Figure 2:
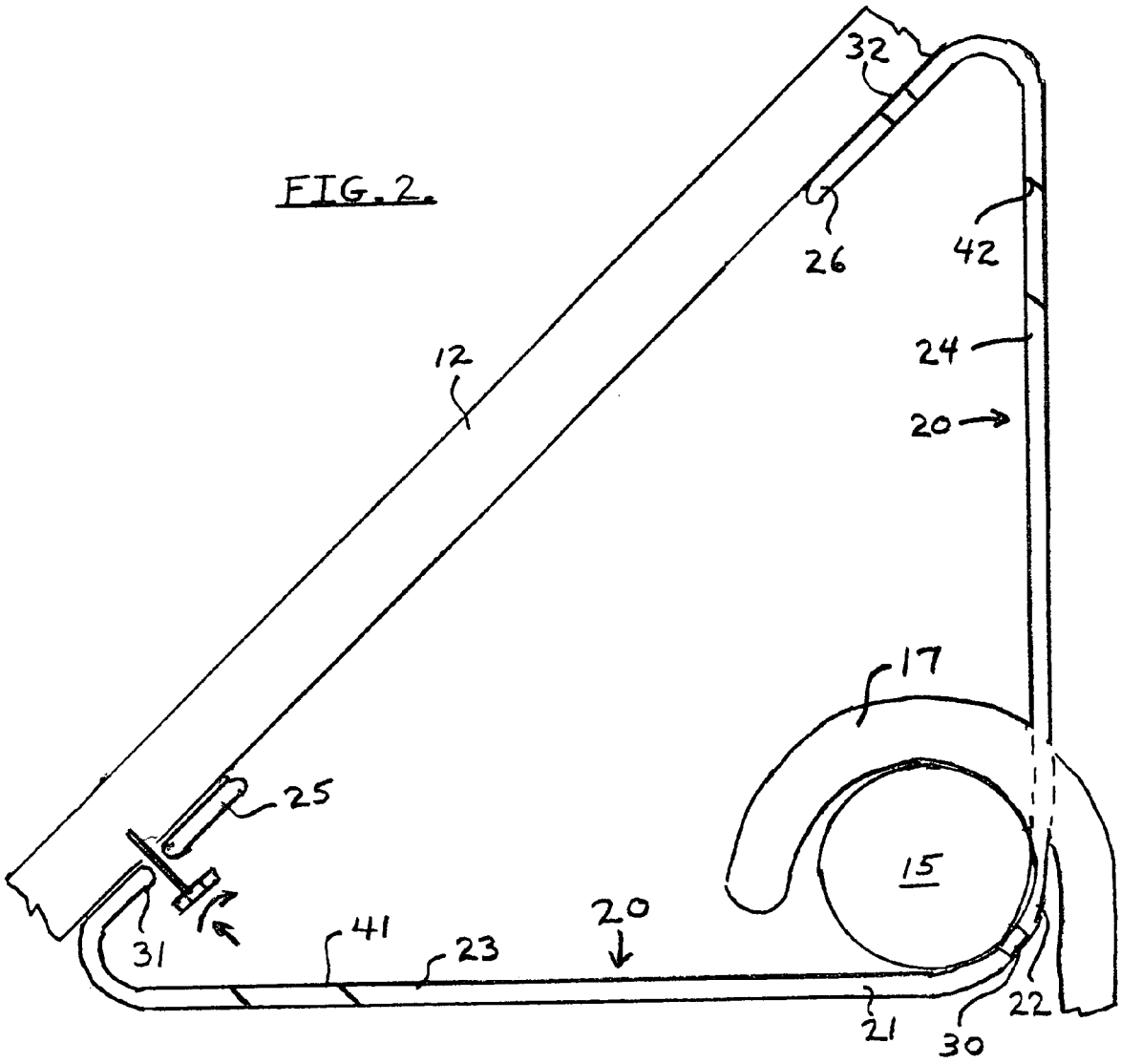
FIG. 2 is a side schematic view of a bracket or support which is utilized to hang clothing in a spaced relation relative to a sloped attic ceiling.

Referring to drawing FIG. 2, closet rod 15 is shown schematically as supported by bracket 20 and attached to the sloping ceiling wall 12.

Ceiling bracket 20 comprises a left hand closet rod supporting section 21 and a right hand closet rod supporting section 22.

The supporting sections 21 and 22 are at an angle of approximately ninety degrees relative to each other.

The ceiling bracket 20 further includes a left hand arm 23 and a right hand arm 24 both of which extend toward the sloped ceiling 12.

The ceiling bracket 20 also includes a left hand mounting flange 25 and a right hand mounting flange 26.

The respective mounting flanges 25 and 26 have apertures 31 and 32 formed therein to provide for mounting via screws or equivalent fasteners to the sloped ceiling.

Aperture 30 is provided to accommodate screw mounting of closet rod 15 to the bracket 20.

Referring further to FIG. 2, the ceiling bracket 20 also includes pilot holes or apertures 41 and 42.

A left hand pilot aperture 41 is provided toward the end of the extended left hand arm 23.

A right hand pilot aperture 42 is positioned toward the end of the extended right hand arm 24.

As an example, the center of each of the pilot apertures would be about 1.25 inches from the end of the respective arms 23 and 24.

Figure 3:
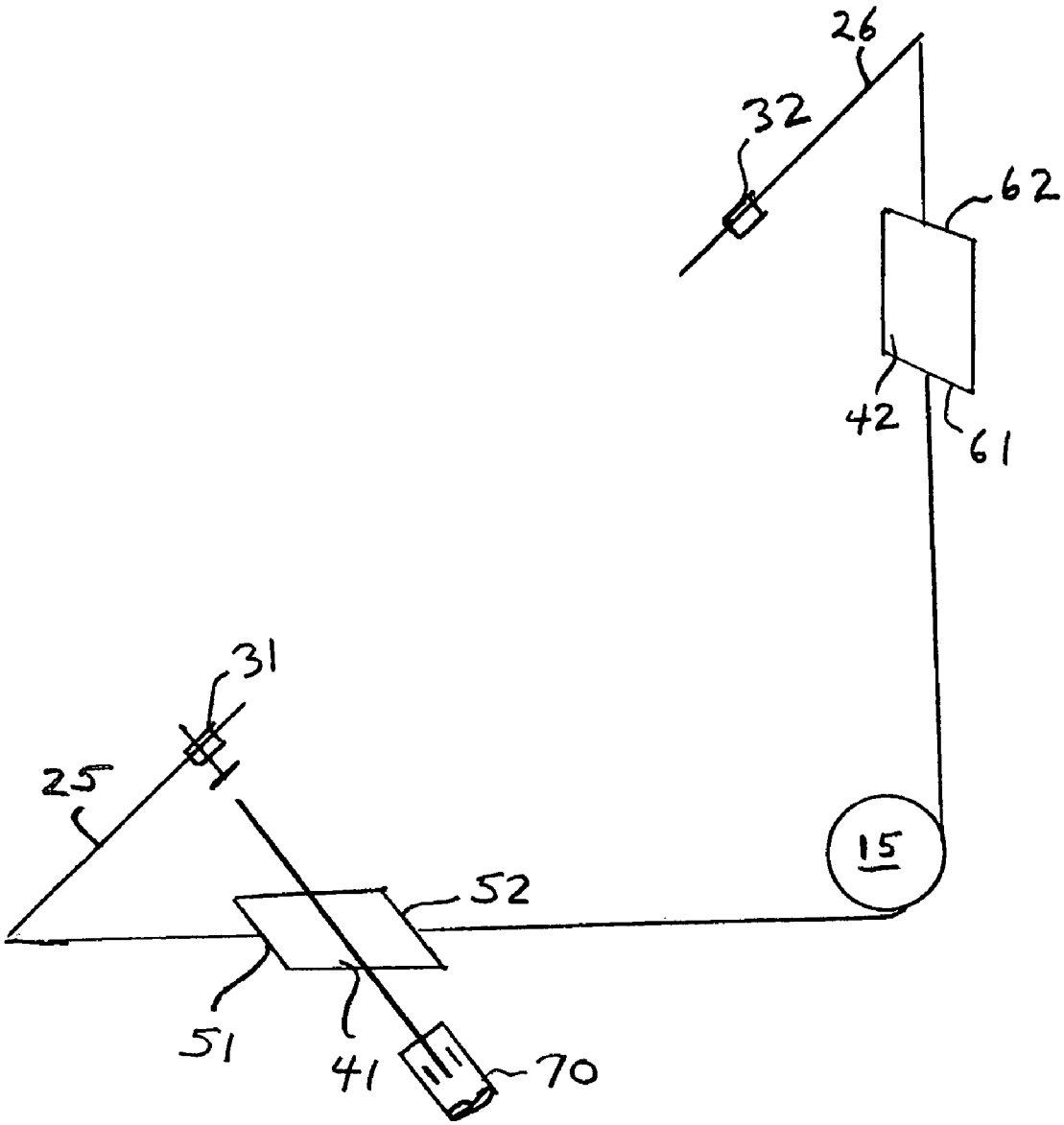
FIG. 3 is a schematic view of pilot holes or apertures used in practice of the invention.

As indicated in FIG. 3, the edges of the pilot hole 41 are angled at about forty five degrees as shown at numerals 51 and 52. The edges of pilot hole 42 are similarly angled as shown at numerals 61 and 62.

Such pilot hole configurations enable a screw driver 70 to be efficiently guided toward the ceiling mounting apertures 31 and 32, thus enhancing speed of installation and providing a more secure mounting.

Figure 4:
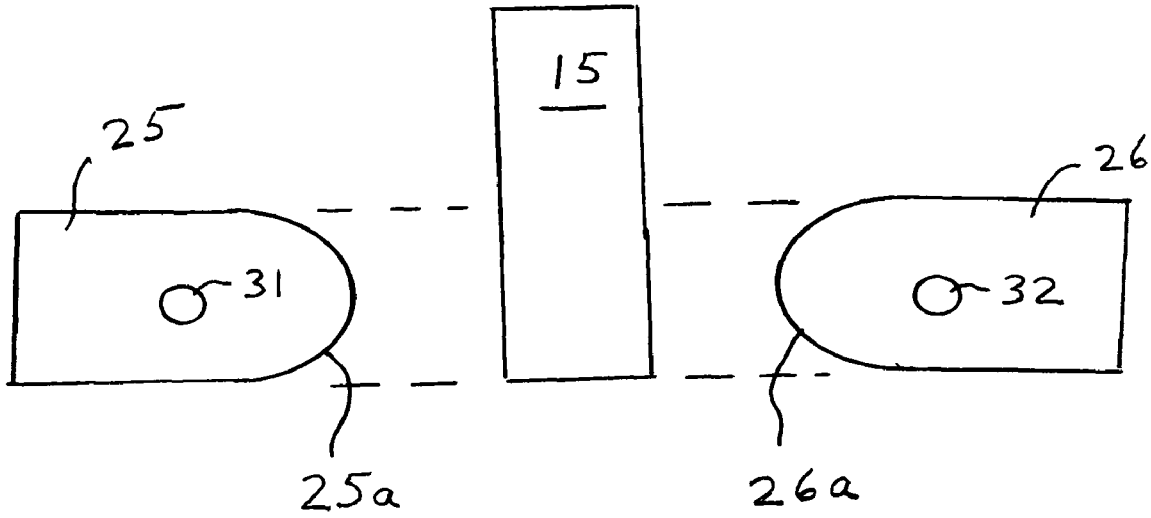
FIG. 4 is a top schematic view of the right and left hand mounting flanges.

Referring to FIG. 4, showing a top view of the mounting flanges 25 and 26, it is seen that such flanges have curved or rounded edges as indicated at numerals 25*a* and 26*a*. The rounded edges enable a construction installer to more easily and safely handle the overall bracket or hanger thus making the installation more efficient.

It is a significant aspect of the invention that the mounting flanges 25 and 26 extend toward each other so that the mounting apertures 31 and 32 are closer together. Such a configuration effectively reduces the length of the moment arm to the closet rod and clothes supported thereon. Thus, less torque is created on the bracket and supporting screws so that a more secure and stable attachment is achieved.

It is contemplated that the materials used for the bracket or hanger would comprise high-grade steel which may be coated or anodized by known processes. Other equivalent materials such as hybrids or highly reinforced plastics may also be utilized.

Figure 5:
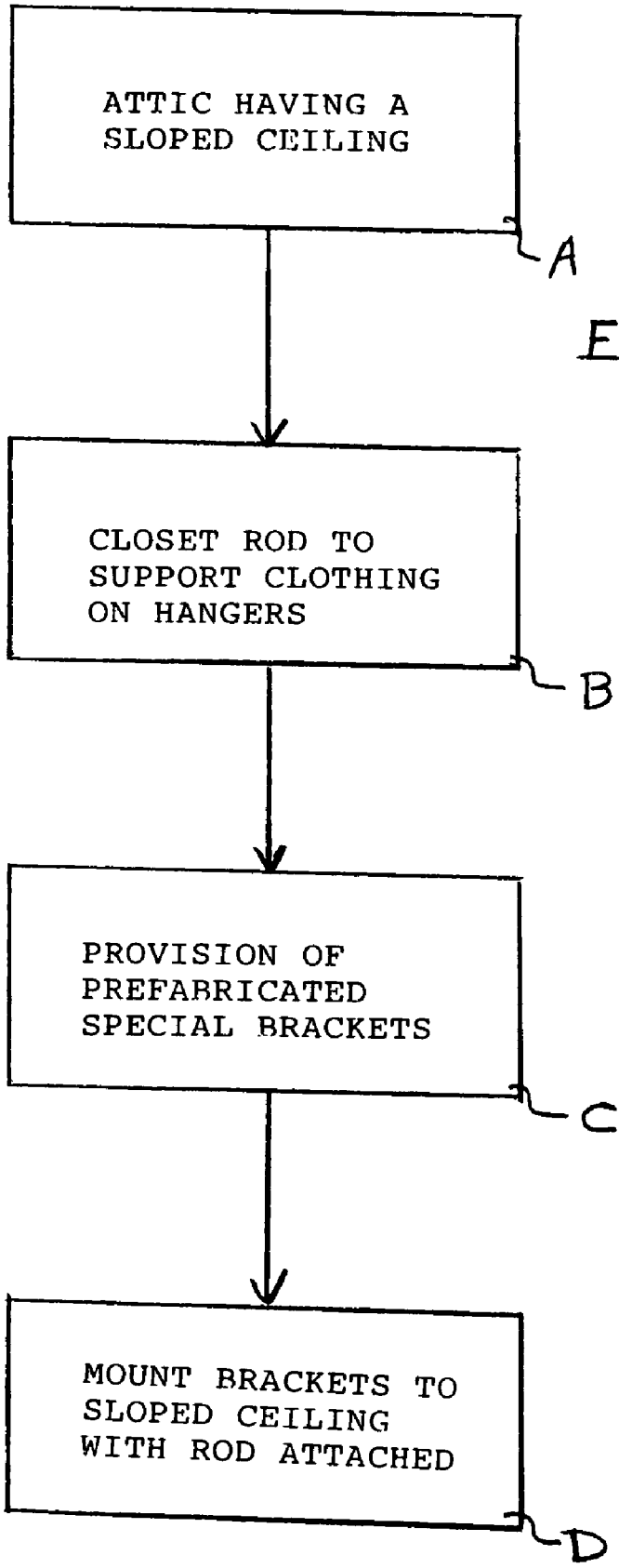
FIG. 5 is a block diagram of the method steps used in practice of the invention.

FIG. 5 illustrates in schematic form the general method steps utilized in practice of the invention.

In step A, an attic or equivalent storage area is provided and is of a type having at least one sloped ceiling.

In step B, a closet rod of a type generally used in the art for the support of clothes on hangers is provided.

In step C, a pair of brackets are provided which have been pre-fabricated in accordance with the present specification, i.e. having a pair of extending arms 23 and 24, aperture means 30 for attachment of the closet rod and inwardly extending mounting flanges 25 and 26 to name a portion of the critical invention items.

In step D, the brackets are mounted to the sloped ceiling and a closet rod is attached between them by suitable screw elements.

While a particular device, system and method of use have been described and shown, it is intended herein to cover all equivalent designs and methods of use which would reasonably occur to those of skill in the support and related mechanical and construction arts.

The invention is further defined by the claims included herewith.

I claim:

1. An angle ceiling bracket for use with a closet rod attached to a sloped ceiling, said angle ceiling bracket including a left hand closet rod supporting section and a right hand closet rod supporting section, said sections being at an angle of about ninety degrees to each other, said angle ceiling bracket further including a left hand arm extending toward said sloped ceiling and a right hand arm extending toward said sloped ceiling, said angle ceiling bracket further including a left hand mounting flange extending at an angle of about forty five degrees from said left hand arm and a right hand mounting flange extending at an angle of about forty five degrees from said right hand arm, wherein said flanges have apertures formed therein for mounting to a sloped ceiling or to a flat mounting surface, said ceiling bracket being in combination with and attached to an angled ceiling (12) of a building, said ceiling bracket being in further combination with a closet rod (15), said closet rod (15) and said ceiling bracket being in further combination with at least one hanger (17) which supports clothing (18), wherein a space (19) is provided so that the clothing does not rub against the angled ceiling wall (12), wherein damage to the clothing (18) is avoided and said clothing is displayed in an attractive manner, wherein the bracket left hand mounting flange (25) and the bracket right hand mounting flange (26) extend inwardly toward each other and are flat in shape to provide mounting means with an angled ceiling structure (12).

* * * * *